United States Patent [19]

Beuke

[11] Patent Number: 4,919,018

[45] Date of Patent: Apr. 24, 1990

[54] HYDRAULIC POWER WRENCH

[75] Inventor: Karl Beuke, Neunkirchen-Seelscheid, Fed. Rep. of Germany

[73] Assignee: Paul-Heinz Wagner, Fed. Rep. of Germany

[21] Appl. No.: 295,868

[22] Filed: Jan. 11, 1989

[30] Foreign Application Priority Data

Jan. 23, 1988 [DE] Fed. Rep. of Germany ... 8800773[U]
Mar. 10, 1988 [DE] Fed. Rep. of Germany ..... 3807924
Apr. 8, 1988 [DE] Fed. Rep. of Germany ..... 3811776

[51] Int. Cl.[5] ..... B25B 13/46
[52] U.S. Cl. ..... 81/57.39
[58] Field of Search ..... 81/57.39, 57.4, 57.26

[56] References Cited

U.S. PATENT DOCUMENTS 4,309,923 1/1982 Wilmeth ..... 81/57.39 X
4,440,046 4/1984 Hirtsiefer et al. ..... 81/57.39
4,663,997 12/1987 Junkers ..... 81/57.39

*Primary Examiner*—D. S. Meislin
*Attorney, Agent, or Firm*—Diller, Ramik & Wight

[57] ABSTRACT

The power wrench is provided with a hydraulic cylinder unit (12) and a wrench head (10). The cylinder unit (12) is movable with an arm (11) of the wrench head along a female guiding track (15), which is substantially parallel to the axis (16) of the wrench head (10). This way, the wrench head (10) may be less wide than the cylinder unit (12) and the cylinder unit (12) can be set so as not to collide with obstacles near the screw head to be turned.

17 Claims, 5 Drawing Sheets

HYDRAULIC POWER WRENCH

BACKGROUND OF THE INVENTION

The invention relates to a hydraulic power wrench.

In known hydraulic power wrenches, the cylinder of the cylinder unit is fixedly connected to the wrench head, whereas the piston presses against a support arm, which is rotatably connected with the wrench head (U.S. Pat. No. 4,440,046). The wrench head is set on the screw to be turned, while the support arm is set against a stationary abutment to divert the reaction forces occurring during the screwing. The wrench head contains a ratchet to effect a rotational pulling of the screw only in the intended direction of rotation, but not in the opposite direction, during the translational movements of the piston of the cylinder unit.

Moreover, hydraulic power wrenches are known that are not provided with a support arm pivotable around the axis of the wrench head. With these power wrenches, the support on the stationary abutment is effected by the end of the piston of the cylinder unit pressing directly on the abutment. Also in this case, the cylinder unit is integrally connected with the wrench head.

Power wrenches often have to be set on not easily accessible screws. In that case, the cylinder unit can be hindering when setting the power wrench on a screw. This is particularly true, if the wrench head is of the same width (axially to the screw) as the cylinder unit, since the casing of the cylinder unit requires a fairly large width. In some instances, the wrench head can only be set on half the length of the screw head or even on the outer edge of the screw head only, because the comparatively large volume of the cylinder unit prevents a full setting of the wrench head on the screw for outer impediments.

It is an object of the invention to provide a hydraulic power wrench that can be adapted to the constructional conditions near the screw head to be turned and that is suited for turning screws that are not easily accessible.

The cylinder unit of the power wrench according to the invention is displaceable relative to the wrench head, the direction of the displacement being generally parallel to the axis of the wrench head or the axis of the screw to be turned. When the power wrench is actuated, no force acts in the direction of the guiding track, along which the cylinder unit is displaceable relative to the wrench head, so that it is not necessary to fix the cylinder unit to the wrench head. The cylinder unit may be freely displaceable in the guiding track, however, it is also possible to provide a locking device that has to be disengaged in order to allow a displacement. It is important that the cylinder unit may be displaced in the direction of the axis of the wrench head and that it may be set in different positions.

Preferably, the cylinder unit can be shifted along the guiding track as far as to be completely removed from the wrench head. Thus, it is possible to use the wrench head in connection with different cylinder units that only have to be inserted into the guiding track of the wrench head.

The width of the cylinder unit (in the direction of the axis of the wrench head) is substantially determined by the diameter o the hydraulic cylinder. In order to keep the hydraulic pressure within the cylinder from being too high, the cylinder unit should not be too small of size. Normally, the cylinder head is arranged symmetrical to the central longitudinal plane of the cylinder unit. The movability of cylinder unit and wrench head make it possible to displace the cylinder unit with regard to the central plane of the wrench head, so that the wrench head can be fully set on the screw head to be turned, even if this screw head has a small height.

The wrench head, due to its very narrow width, is lightweight and can also be set in locations that are not easily accessible.

An additional intermediate track provides still greater possibilities of movement and adaptation. This intermediate track also needs only to be inserted loosely into he guiding track of the wrench head and does not require locking. Further, the cylinder unit can be loosely inserted into the guiding track of the track, without having to be locked. Preferably, the guiding tracks of the wrench head and the intermediate track are of the same profile, so that the cylinder casing can be alternatively inserted into the guiding track of the wrench head or that of the intermediate track. Thus, the intermediate track is provided at its opposite ends with two mutually complementary profiles.

Using the intermediate track, it is possible to use several cylinder units at the same time to increase the rotary force. For example, the rotary force needed to loosen a screw may be much greater than the rotary force needed to tighten that screw. If the force of a single cylinder unit is not sufficient, a second cylinder unit can be inserted into the intermediate track, with both cylinder units being operated simultaneously.

If a support arm is used that is supported against a stationary abutment, this support arm is preferably provided at or in a socket wrench that is set on the wrench head. The support arm is substantially of U-shape and it is provided with an outer leg, extending parallel to the axis of the wrench head, against which leg the piston of the cylinder unit presses.

The wrench head can also be used in different angular positions with regard to the cylinder unit, due to the wrench head being adjustable around the centre of the profile of the guiding track. The position of the axis of the wrench head with regard to the abutting element can thus be varied. This allows an adaptation of the device to many screwing situations by simply changing the position of the wrench head on the cylinder unit. Preferably, the profile of the guiding track is integrally formed with the cylinder casing. Also when using a guiding track that allows different angular positions of the wrench head with regard to the cylinder unit, the wrench head can be set on the cylinder unit after having been turned by 180° (upside down), so that the screw can be rotated in both directions of rotation.

BRIEF DESCRIPTION OF THE DRAWING

The combination of the intermediate track and the profile of the cylinder unit allows to simultaneously use of several cylinder units, to displace the wrench head laterally and to change the angle between the cylinder unit and the wrench head.

The following is a detailed description of the embodiments of the invention with reference to the drawings.

In the Figures

Figure 2:
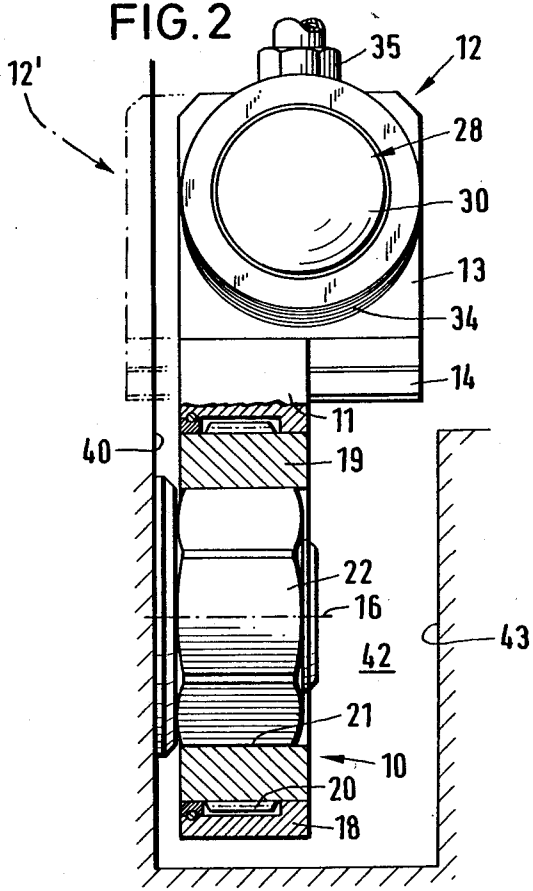
Figure 1:
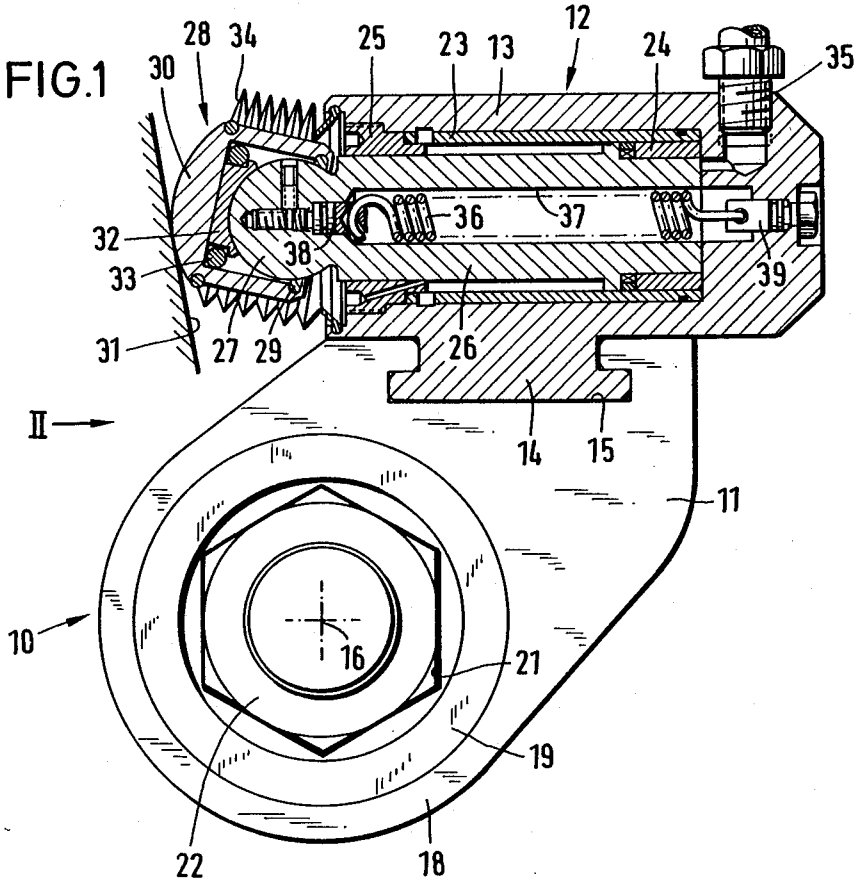
Figure 4:
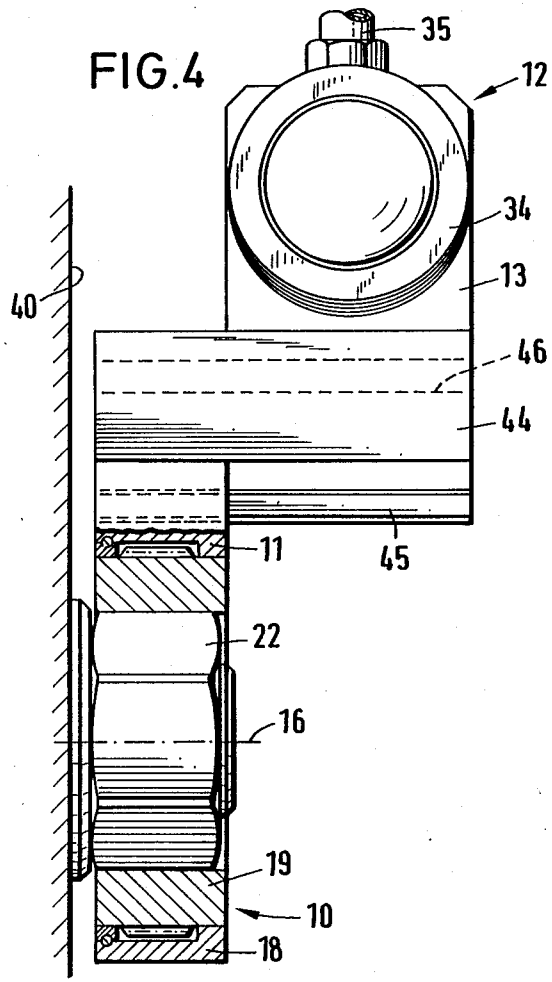
Figure 3:
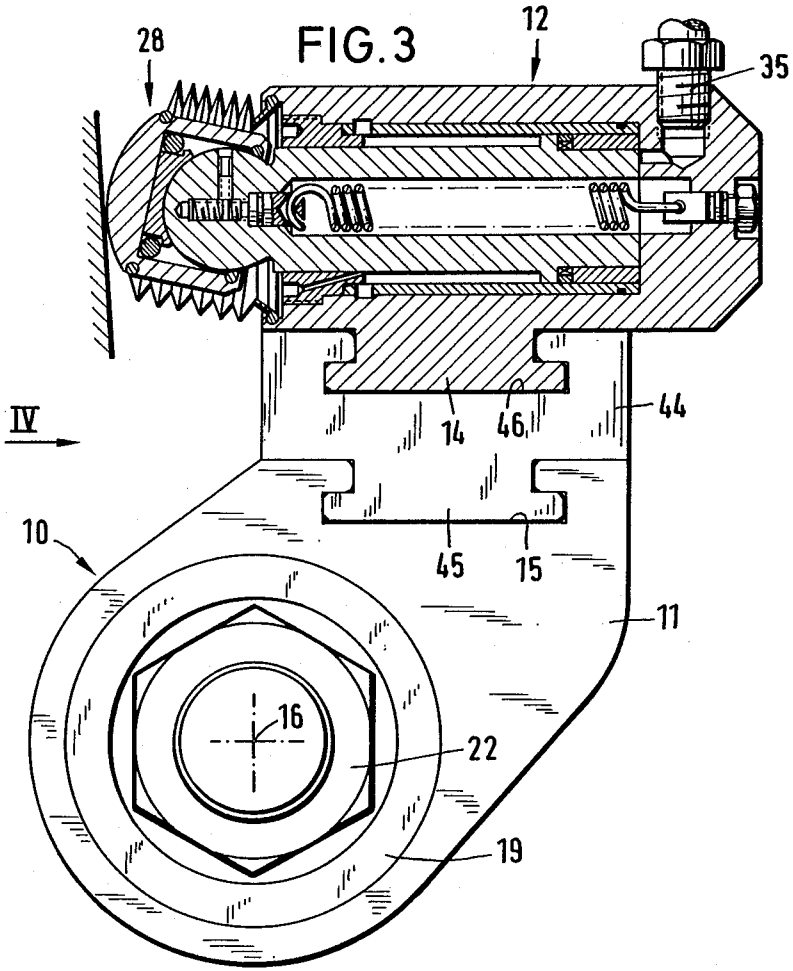
Figure 6:
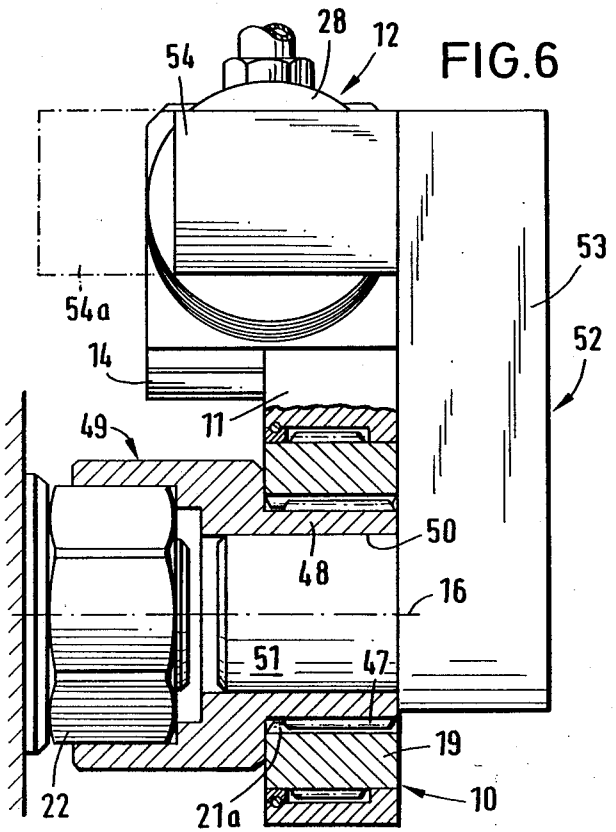
Figure 5:
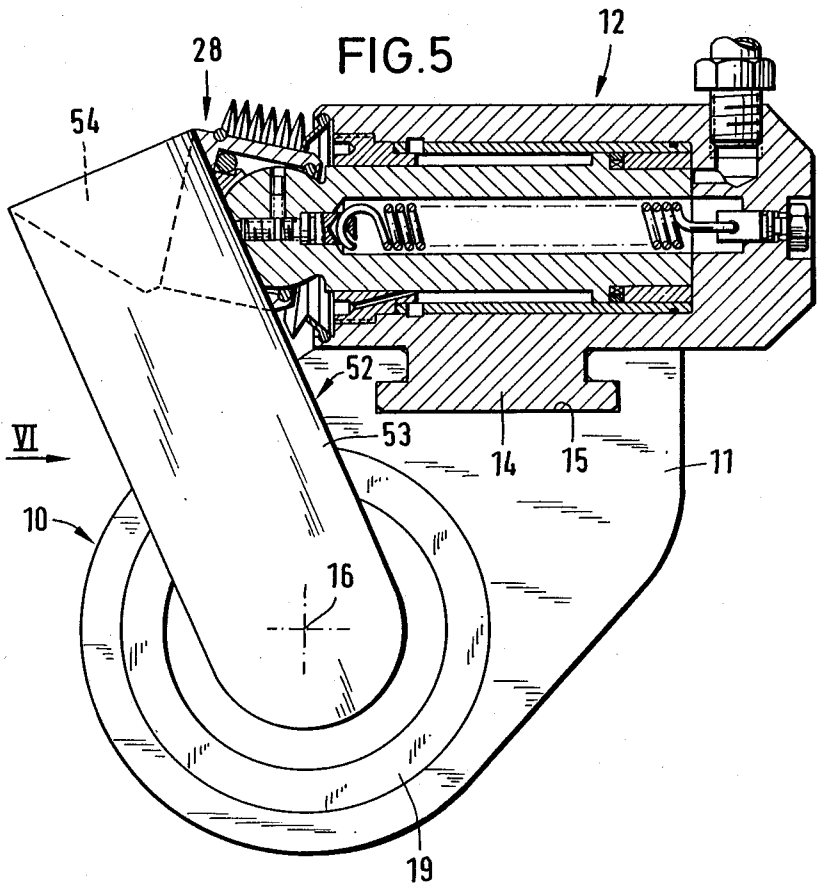
Figure 7:
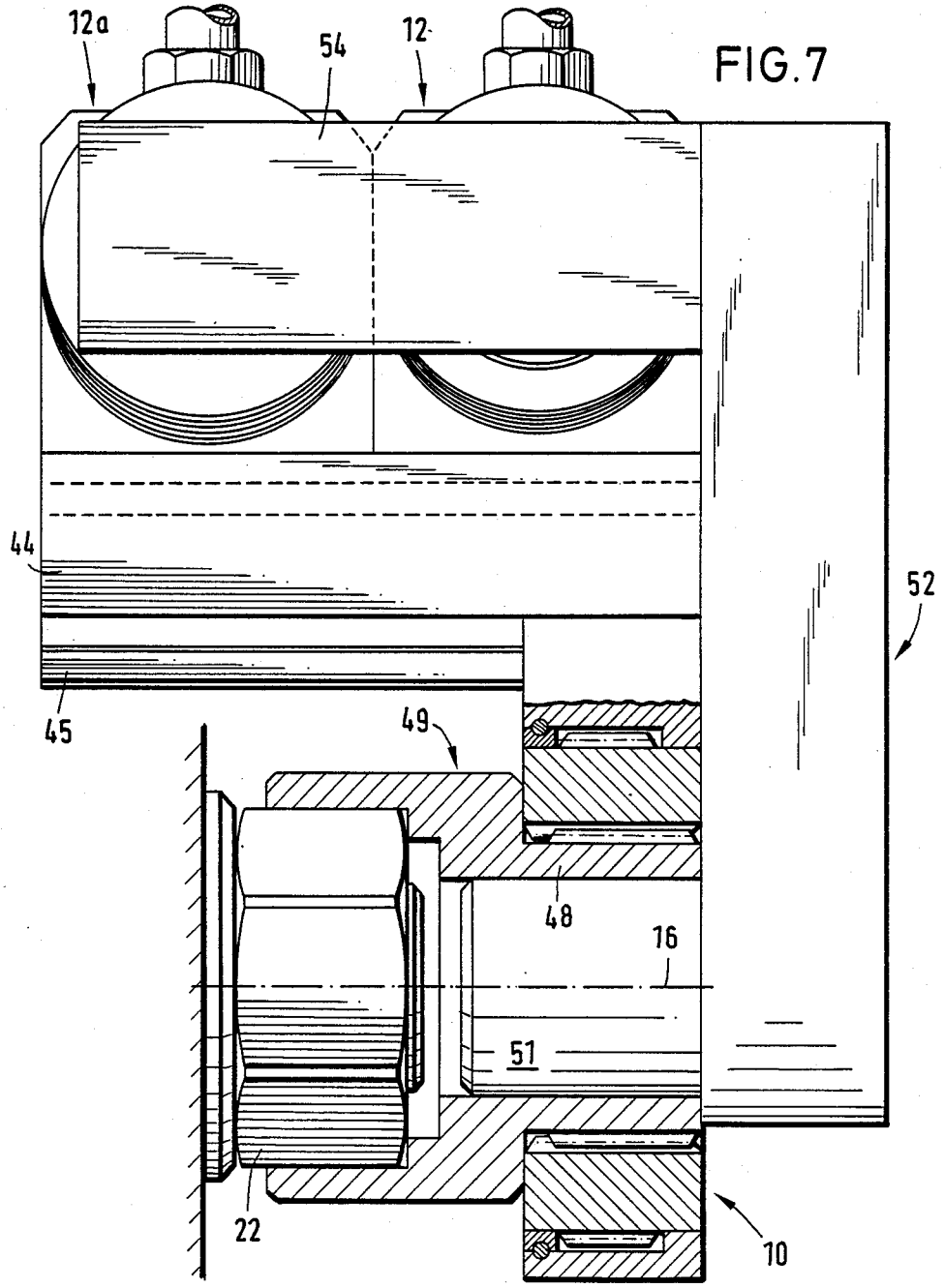
Figure 8:
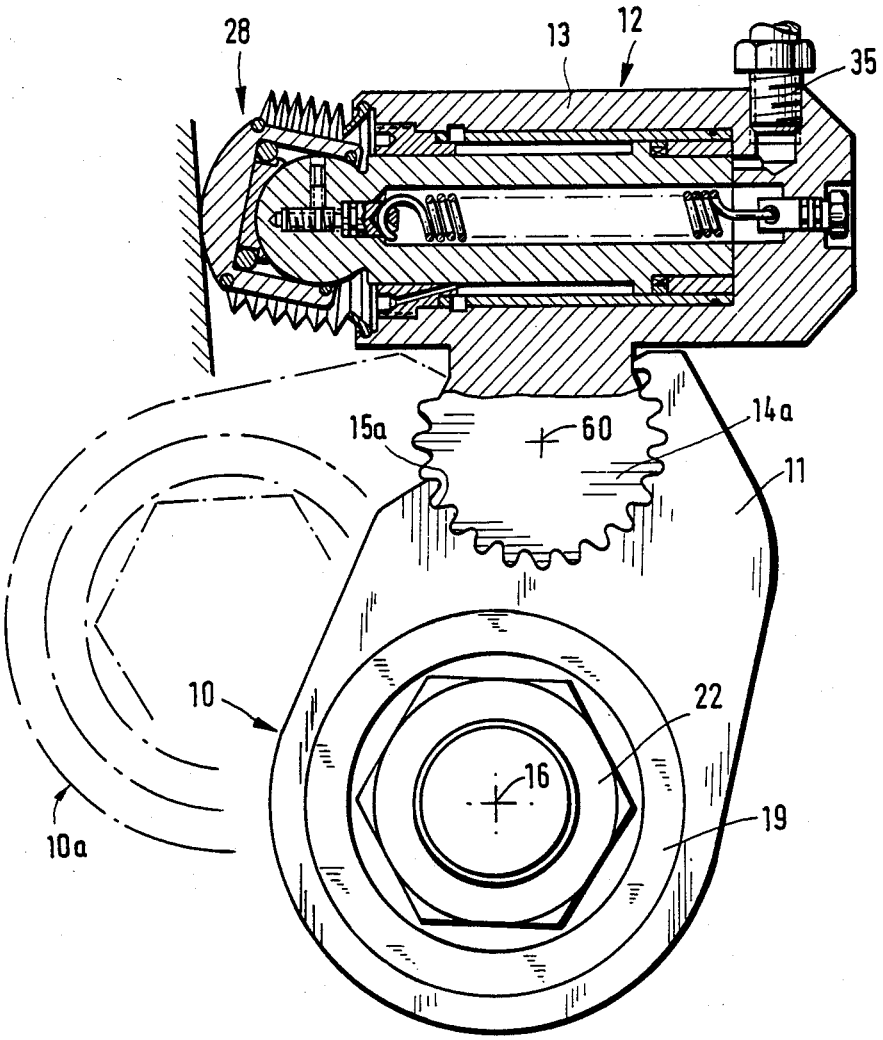

FIG. 1 is a view of the power wrench, with a section of the cylinder unit,

FIG. 2 is a view of the power wrench following the arrow II of FIG. 1, with a section of the wrench head, FIG. 3 is the power wrench as in FIG. 1, but with intermediate track, FIG. 4 is a view of FIG. 3 following the arrow IV, FIG. 5 is the power wrench with the inserted support arm, FIG. 6 is a view of FIG. 5 following the arrow VI, FIG. 7 is an embodiment with intermediate track and support arm, as well as several cylinder units applied on the intermediate track, and FIG. 8 is an embodiment of the power wrench that allows to vary the angle that is defined by the arm of the wrench head and the cylinder unit 12.

DESCRIPTION OF THE PREFERRED EMBODIMENTS

The power wrench according to FIGS. 1 and 2 is provided with an annular wrench head 10 having a generally radially extending arm 11. The cylinder unit 12 is mounted on the end of the arm 11. The casing 13 of the cylinder unit 12 is provided with a linear T-shaped male guiding track in the shape of a ridge 14, which is inserted from the end of the arm 11 into a corresponding female guiding track 15 in the form of a T-shaped groove provided in the arm 11. The female guiding track 15 and the male guiding track 14 extend parallel to the axis 16 of the wrench head 10.

Female guiding track 15 and male guiding track 14 do not necessarily have to extend exactly parallel to the axis 16, but they may also extend diagonally or arcuately. However, the parallel and linear extension is preferred.

The wrench head 10 is provided with annular casing 18 that is integrally formed with the arm 11. A ring is rotatably provided in the casing 18. This ring 19 has an outer toothing 20, in which a ratchet lever (not illustrated), provided in the arm 11 or the casing 18, engages to pull the the ring 19 in only one direction of rotation of the casing 18. The ring 19 is provided with a polygonal bore 21 into which the head of the screw to be turned or the shaft of a socket can be inserted.

The cylinder casing 13 contains a bushing in a cylinder bore, in which bushing the piston 24 can be moved. The front end of the cylinder bore is closed with a screw cap 25 penetrated by the piston rod 26. At the front end of the piston rod 26 a ball 27 is provided, on which a pressure member 28 is pivotably supported. This pressure member 28 consists of a cap enclosing the ball 27 and being secured against being pulled off the ball by a seal ring 29. The front wall 30 of the pressure member 28 is of spherical shape in order to roll on the stationary abutment 31 on which the pressure member 28 acts, during the translational movements of the arm 11 during the screwing. Between the inner side of the front wall 30 and the ball 27 a gliding member 32 is provided that has an indentation adapted to the ball 27 and that is centered by an elastic ring 33. One end of a bellows 34 is fastened to the pressure member 28, the other end is fastened to the front wall of the cylinder casing 13, this bellows preventing the intrusion of dust into the cylinder casing 13 and the pressure member 28, but allowing the swivelling of the pressure member.

A pressure connector 35 that feeds in the hydraulic oil for the advancement of the piston 24 is provided in the rear of the cylinder casing 13. The withdrawal of the piston is effected by a spring 36 that is accomodated in a longitudinal bore 37 in the piston rod 26 and one end of which is fastened to a retainer 38 screwed into the ball 27, whereas the other end is secured in a retainer 39 that is fastened to the back wall of the cylinder casing 13.

As can be seen from FIG. 2, the width of the wrench head 10 in the direction of the axis of the wrench head 16 is about half the width of the cylinder unit. The width of the wrench head is generally variable and can be adapted to the given situation. The wrench head 10 can be longitudinally displaced along the ridge 14 acting as a male guiding track and extending over the full width of the cylinder unit 12. The position the cylinder unit would take, if the central planes of the cylinder unit and the wrench head would coincide, is represented in FIG. 2 by broken lines and defined as 12'. If the surface 40 from which the head 22 of the screw to be turned protrudes is arranged closely beneath the screw 22, the wrench head 10 is shifted to one end of the male guiding track 14, so that the outer surfaces of the cylinder unit 12 and the wrench head 10 are almost flush, as illustrated in FIG. 2 for the left outer surfaces. It is obvious that the wrench head 10 can be fully set on the screw head 22, without this setting being hindered by the cylinder unit 12.

Moreover, the wrench head 10, due to its narrow width, can also be applied on screws 22, the head space 42 of which is much limited by a wall 43.

The T-groove 15, flowing out freely at both ends, can be freely disposed along the male guiding track 14 and may be drawn off the cylinder unit 12 over the ends of the male guiding track 14. A locking device is not necessary, since at actuating the cylinder unit 12 no force is acting to shift the cylinder unit in the longitudinal direction of the male guiding track 14.

When using the power wrench, pressure intermittently acts on the pressure connection 35. Every time pressure acts on the piston 24, the piston 24 and the piston rod 26 move forward, whereby the fact that the pressure member 28 is supported on the stationary abutment 31 causes a swivelling of the arm 11 around the axis 16. The screw 22 is pulled in this direction of rotation. After the subsequent pressure release, the piston 24 is pushed into the withdrawal position by the spring 36, whereby the arm 11 is withdrawn. During this backward movement of the arm 11, the ring 19 is not turned, due to the ratchet engaging with the toothing 20, so that the head 22 of the screw remains in its position.

The embodiment in FIG. 3 and 4 uses the wrench head 10 and the cylinder unit 12 of the first embodiment, however, with an intermediate track 44 being provided between both parts. The intermediate track 44 has a guiding track 45 in form of a T-shaped ridge and a T-groove 46 extending parallel thereto, both extending over the whole length of the intermediate track 44. The guiding track 45 is inserted into the T-groove 15 of the wrench head 10 and the male guiding track 14 of the cylinder unit 12 is inserted into the T-groove 46 of the intermediate track 44. The length of the intermediate track 44 longitudinal to the axis 16 is almost twice the width of the cylinder unit 12. Therefore, the cylinder unit 12 can be arranged at a considerable distance from the surface 40. This is particularly expedient, if other constructional parts are provided on the surface 40 that require a distance between the cylinder unit 12 and that surface.

The embodiment in FIGS. 5 and 6 uses the same cylinder unit 12 as the preceding embodiments. The wrench head 10 is basically provided in the same way as in the preceding embodiments, however, the ring 19 provided with an inner toothing 21*a* instead of a polygonal bore 21, in which an outer toothing 47 at the shaft 48 of a socket wrench 49 is inserted. The socket wrench 49 is applied on the screw head 22. The shaft 48 of the socket wrench is provided with a bore 50 in which the shaft 51 of the support arm 52 is inserted from the back end. Thus, the support arm 52 is coaxially supported in the ring 19. The support arm is U-shaped and it has a base 53 from which the shaft 51 and, parallel thereto, the leg 54 extend. The pressure member 28 of the cylinder unit 12 laterally presses against the leg 54, the opposite side of which acts on a stationary abutment (not illustrated). As can be seen in FIG. 5, the leg 54 has a triangular profile, the point of the triangle being directed toward the shaft 51. The support arm 52 has the shape of a U-shaped yoke that extends backward from the wrench head 10 and the leg 54 of which lies within the range of movement of the pressure member 28. According to FIG. 6, the leg 54 may be prolonged over the length of the shaft 51, as indicated by the dot-dash lines of 54*a*, in order to achieve a support on a stationary abutment that the pressure member 28 cannot reach.

FIG. 7 shows an embodiment in which the support arm 52 is rotatably supported in the socket wrench 49 with its shaft 51, additionally using an intermediate track 44, along the guiding track 45 of which the wrench head 10 is displaceable and along which also the cylinder unit 12 can be displaced parallel to the axis 16. Besides the cylinder unit 12, a second cylinder unit 12*a* is provided on the intermediate track 44 that is operated simultaneous to the first cylinder unit 12, both cylinder units jointly pressing against the leg 54 of the support arm 52. This way, the power of a single cylinder unit can be multiplied.

The embodiment in FIG. 8 corresponds to that of the FIGS. 1 and 2, so that the following explanation can be reduced to the differences. According to FIG. 8, the guiding track 14*a*, being an integral part of the cylinder case 13, consists of a toothed profile of a constant cross section over the length of the guiding track 14*a*. The toothing is provided on a circle around the axis 60 of the guiding track 14*a*. The guiding track 15*a*, provided at the arm 11 of the wrench head 10, consists of a profile complementary to the profile of the guiding track 14*a*, i.e. in the given case: an inner toothing. Due to the engagement of both toothed profiles, the wrench head 10 may be inserted into the guiding track 14*a* in different angular positions, e.g. in the position 10*a*, represented in FIG. 8 by dot-dash lines. The perimetric extension of the profile of the guiding track 14*a* is larger than the perimetric extension of the complementary profile of the guiding track 15*a*, so that it is possible to engage profile and complementary profile in different angular positions. The axis 60 extends parallel to the axis 16. The wrench head 10 can be shifted freely along the guiding track 14*a*. In this case, the inner profile of the guiding track 15*a* extends over an angular range slightly larger than 180° and the outer profile of the guiding track 14*a* extends over an angular range that is larger by about 30° to 40°.

Instead of engaging toothed profiles, one may also use polygonal profiles.

In the embodiment in FIG. 8 in which the wrench head 10 and the cylinder unit 12 can be fixed on various positions of rotation around the axis 60, the wrench head 10 and the cylinder unit do not have to be freely displaceable along the axis 60. Providing a locking device that allows the change of the angle without an axial displacement, would also lie within the scope of the invention.

I claim:

1. An hydraulic power wrench having a cylinder unit (12) and a wrench head (10) connected to a casing (13) of said cylinder unit (12), said wrench head (10) having an axis (16) of rotation and being connectable with a screw (22) to be turned for a rotational pulling of said screw, a piston rod (26) slidably disposed within said casing (13) of the cylinder unit (12) and having a pressure means for supporting contact against a stationary abutment (31), a guiding track formed in the casing in slidable engagement with a guiding track formed in the wrench head, said guiding tracks are is disposed generally parallel to the axis of the wrench head (10) such that the casing is displaceable relative to the wrench head along said axis.

2. The hydraulic power wrench according to claim 1, characterized in that a width of the wrench head (10) in the direction of said axis is less than the width of the casing (13) in said direction.

3. The hydraulic power wrench according to claim 2, characterized in that the width of the wrench head (10) is about half the width of the casing (13).

4. The hydraulic power wrench according to claim 1, characterized in that, extending parallel to the axis (16) of the wrench head, an intermediate track means slidably engaging the guiding tracks of the wrench head (10) and the casing (13); such that said intermediate track member (44) is generally axially displaceable relative to the wrench head (10), and said casing (13) is axially displaceable relative to said intermediate track member (44).

5. The hydraulic power wrench according to claim 4, characterized in that the intermediate track member (44) has a cross-sectional shape (45) complementary to a cross-sectional shape (15) of the guiding track of the casing (12).

6. The hydraulic power wrench according to claim 4, characterized in that the length of the intermediate track member (44) is greater than the width of the casing (13) in the direction of the axis of the wrench head (10).

7. The hydraulic power wrench according to claim 6, characterized in that at least another cylinder unit (12*a*) is provided generally parallel to said first-mentioned cylinder unit (12) and connected to said wrench head (12) includes a casing, a piston, said another cylinder unit rod slidably disposed within said casing and having a pressure means for supporting contact against the stationary abutment (31), an abutment engaging support arm (52) pivotable about the axis (16) of the wrench head (10) and against said piston rods which are aligned for bearing contact therewith.

8. The hydraulic power wrench according to claim 1, characterized in that a support arm (52) is supported in a back end of a shaft (48) of a socket wrench (49) that is attached to the wrench head (10), and said support arm (52) is provided with a outer leg (54) that extends parallel to the axis (16) of the wrench head (10).

9. The hydraulic power wrench according to claim 1, wherein the pressure means is pivotable on an outer end of the piston rod.

10. The hydraulic power wrench according to claim 9, characterized in that the presence means (28) has a spherical contact surface to engage the stationary abutment (31).

11. A hydraulic power wrench having a cylinder unit (12) and a wrench head (10) connected to a casing (13) of said cylinder unit (12), said wrench head (10) having an axis (16) of rotation and being connectable with a screw (22) to be turned for a rotational pulling of said screw, a piston rod (26) slidably disposed within the casing (13) of the cylinder unit (12) and having a pressure means for supporting contact against a stationary abutment (31), and means (14*a*, 15*a*) for adjustably connecting the wrench head (10) to the casing such that the wrench head may be fixed in different rotational positions relative to the casing about an axis parallel to said axis of rotation.

12. The hydraulic power wrench according to claim 11, characterised in that the means for connecting includes a guiding track on the wrench head and a guiding track on the casing (14*a*, 15*a*) with complimentary cross-sectional shapes.

13. The hydraulic power wrench according to claim 12, characterised in that said cross-sectional shapes are each toothed.

14. The hydraulic power wrench according to claim 12, characterised in that said cross-sectional shapes each extends over a perimetric range of 120 to 240 degrees.

15. A hydraulic power wrench having a cylinder unit (12), an annular wrench head (10) connected to a casing of the cylinder unit (12), said wrench head being connectable with a screw (22) to be turned for a rotational pulling of said screw (22), a piston rod slidably disposed within the casing and having a pressure means for engagement with a support arm (52), said support arm having one end for engagement with an abutment, a socket wrench (49) having a shaft (48) attached to the wrench head (10) for engagement with a screw to be turned the support arm (52) is rotatably journalled in engagement with a pivot bearing (50) of said shaft (48) of said socket wrench (49).

16. The hydraulic power wrench according to claim 15, characterized in that the other end of the support arm (52) is a bearing neck (51) journalled in engagement with said pivot bearing (50), said one end of said support arm is a leg (54) extending generally parallel to said bearing neck.

17. The hydraulic power wrench according to claim 5, characterised in that the length of the intermediate track member (44) is greater than the width of the casing (13) in the direction of the axis of the wrench head (10).

* * * * *